US009206704B2

(12) United States Patent
Saha et al.

(10) Patent No.: US 9,206,704 B2
(45) Date of Patent: Dec. 8, 2015

(54) CAST CRMOV STEEL ALLOYS AND THE METHOD OF FORMATION AND USE IN TURBINES THEREOF

(71) Applicant: General Electric Company, Schenectady, NY (US)

(72) Inventors: Deepak Saha, Watervliet, NY (US); Subrahmanyam Thangirala, Schenectady, NY (US); Jeffrey Michael Breznak, Waterford, NY (US); Steven Louis Breitenbach, Scotia, NY (US)

(73) Assignee: General Electric Company, Schenectady, NY (US)

( * ) Notice: Subject to any disclaimer, the term of this patent is extended or adjusted under 35 U.S.C. 154(b) by 198 days.

(21) Appl. No.: 13/939,477

(22) Filed: Jul. 11, 2013

(65) Prior Publication Data

US 2015/0017462 A1 Jan. 15, 2015

(51) Int. Cl.

| | |
|---|---|
| ***C22C 38/44*** | (2006.01) |
| ***C22C 38/46*** | (2006.01) |
| ***C22C 38/50*** | (2006.01) |
| ***C22C 38/54*** | (2006.01) |
| ***C21D 9/00*** | (2006.01) |
| ***F01D 25/00*** | (2006.01) |
| ***C22C 38/42*** | (2006.01) |
| ***B22D 25/00*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |

(Continued)

(52) U.S. Cl.

CPC ..... *F01D 25/005* (2013.01); *B22D 25/00* (2013.01); *B22D 27/04* (2013.01); *C21D 6/00* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C22C 38/60* (2013.01); *F05D 2230/21* (2013.01); *Y10T 428/12* (2015.01)

(58) Field of Classification Search

None

See application file for complete search history.

(56) References Cited

U.S. PATENT DOCUMENTS

| | | | |
|---|---|---|---|
| 4,855,106 | A | 8/1989 | Katsumata et al. |
| 6,419,453 | B2 | 7/2002 | Fukui et al. |

(Continued)

FOREIGN PATENT DOCUMENTS

| | | | |
|---|---|---|---|
| BE | 700498 | A | 12/1967 |
| EP | 0159119 | | 10/1985 |

(Continued)

OTHER PUBLICATIONS

Combined Search and Examination Report issued in connection with corresponding Application No. GB1412142.0 on Feb. 12, 2014.

*Primary Examiner* — Deborah Yee

(74) *Attorney, Agent, or Firm* — Dority & Manning, P.A.

(57) ABSTRACT

A cast alloy is generally provided, along with methods of forming the cast alloy and components constructed from the cast alloy (e.g., stationary components of a turbine). The cast alloy can include, by weight, 0.12% to 0.20% carbon, 0.50% to 0.90% manganese, 0.25% to 0.60% silicon, 0.10% to 0.50% nickel, 1.15% to 1.50% chromium, 0.90% to 1.50% molybdenum, 0.70% to 0.80% vanadium, 0.0075% to 0.060% titanium, 0.008% to 0.012% boron, the balance iron, optionally low levels of other alloying constituents, and incidental impurities.

20 Claims, 4 Drawing Sheets

(51) Int. Cl.

| | |
|---|---|
| ***C22C 38/60*** | (2006.01) |
| ***B22D 27/04*** | (2006.01) |
| ***C21D 6/00*** | (2006.01) |

(56) References Cited

U.S. PATENT DOCUMENTS

| | | | | |
|---|---|---|---|---|
| 8,523,519 | B2 * | 9/2013 | Breitenbach et al. | ..... 415/216.1 |
| 2006/0216145 | A1 | 9/2006 | Arai et al. | |
| 2009/0314390 | A1 | 12/2009 | Gigliotti, Jr. et al. | |
| 2010/0147247 | A1 | 6/2010 | Qiao et al. | |
| 2011/0070088 | A1 | 3/2011 | Breitenbach et al. | |
| 2012/0273093 | A1 | 11/2012 | Hanlon et al. | |
| 2012/0312426 | A1 | 12/2012 | Suzuki et al. | |
| 2012/0312434 | A1 | 12/2012 | Suzuki et al. | |
| 2013/0000862 | A1 | 1/2013 | Cretegny et al. | |
| 2013/0101431 | A1 | 4/2013 | Farineau et al. | |
| 2013/0126056 | A1 | 5/2013 | Feng et al. | |
| 2013/0128031 | A1 | 5/2013 | Singh et al. | |

FOREIGN PATENT DOCUMENTS

| | | |
|---|---|---|
| EP | 1123984 | 8/2001 |
| JP | 59-226152 | 12/1984 |
| JP | 62-192536 | 8/1987 |
| JP | 63-145750 | 6/1988 |

* cited by examiner

CAST CRMOV STEEL ALLOYS AND THE METHOD OF FORMATION AND USE IN TURBINES THEREOF

FIELD OF THE INVENTION

The invention relates generally to the field of steel alloy castings and related methods and articles. In one embodiment, a high temperature, high strength cast CrMoV steel alloy is generally disclosed, along with methods of making an article therefrom.

BACKGROUND OF THE INVENTION

Components of steam turbines, gas turbines, gas turbine engines, and jet engines experience a range of operating conditions along their axial lengths. Not only do the different operating conditions complicate the selection of a suitable casting material and manufacturing, but also the material and manufacturing of the stationary components of such turbines are impacted. For example, a material optimized to satisfy one operating condition may not be optimal for meeting another operating condition. For instance, the inlet and exhaust areas of a steam turbine casting have different material property requirements compared to requirements of a gas turbine. For example, steam turbine casings in general are pressurized chambers at high temperatures and are hence are creep limited. On the other hand, gas turbine casings are typically exposed to frequent thermal cycling and could be fatigue limiting. These properties, which are sometimes conflicting, are tailored with a suitable mix of heat treatment cycles to achieve an optimum mixture of strength, toughness, creep and fatigue properties, depending on application.

For casings and other casting components, the steam turbine industry currently favors CrMoV low alloy steels for temperatures below 1050° F. As higher inlet temperatures are sought, for example up to about 1060° F. (about 575° C.), to increase steam turbine efficiencies, chromium steel alloys having about 9 to 14 weight percent chromium with varying levels of Mo, V, W, Nb, B are typically be used to meet the higher temperature conditions in the HP stage of the steam turbine. While capable of operating at temperatures exceeding 565° C. within the HP stage of a steam turbine, casting components produced from these alloys incur higher costs and additional measures are often required to address thermal expansion mismatches with alloys used in the casting components of cooler stages.

Not only are such high-Cr steel alloys expensive to produce, but also they are not particularly well suited for the casting processes utilized to form various stationary components of such turbines (e.g., shell, valve, diaphragm, packing head, or packing ring). Currently, various stationary components of such turbines are typically made with CrMoV steel alloys (for components exposed to temperatures up to 1050° F.) and 9-12% Cr steel alloys (for applications that require either higher temperature or stress). In high temperature applications, the cost of the 9-12% Cr steel alloys—mainly due to the relatively high amounts of Cr present—can significantly impact the design, component selection, and final cost of the turbine.

BRIEF DESCRIPTION OF THE INVENTION

Aspects and advantages of the invention will be set forth in part in the following description, or may be obvious from the description, or may be learned through practice of the invention.

A cast alloy is generally provided, along with components constructed from the cast alloy (e.g., stationary components of a turbine). In one embodiment, the cast alloy includes, by weight, 0.12% to 0.20% carbon (e.g., 0.14% to 0.17% carbon), 0.50% to 0.90% manganese, 0.25% to 0.60% silicon (e.g., 0.25% to 0.35% silicon), 0.10% to 0.50% nickel (e.g., 0.20% to 0.35% nickel), 1.15% to 1.50% chromium, 0.90% to 1.50% molybdenum, 0.70% to 0.80% vanadium (e.g., 0.74% to 0.77% vanadium), 0.0075% to 0.060% titanium (e.g., 0.010% to 0.035% titanium), 0.008% to 0.012% boron (e.g., 0.009% to 0.010% boron), the balance iron, and incidental impurities such as, but not limited to, up to 0.012 weight percent phosphorous, up to 0.012 weight percent sulfur, up to 0.010 weight percent tin, up to 0.015 weight percent arsenic, up to 0.015 weight percent aluminum, up to 0.0035 weight percent antimony, and up to 0.15 weight percent copper.

For example, the cast alloy, in one particular embodiment, can consist of, by weight, 0.12% to 0.20% carbon (e.g., 0.14% to 0.17% carbon), 0.50% to 0.90% manganese, 0.25% to 0.60% silicon (e.g., 0.25% to 0.35% silicon), 0.10% to 0.50% nickel (e.g., 0.20% to 0.35% nickel), 1.15% to 1.50% chromium, 0.90% to 1.50% molybdenum, 0.70% to 0.80% vanadium (e.g., 0.74% to 0.77% vanadium), 0.0075% to 0.060% titanium (e.g., 0.010% to 0.035% titanium), 0.008% to 0.012% boron (e.g., 0.009% to 0.010% boron), iron, up to 0.012 weight percent phosphorous, up to 0.012 weight percent sulfur, up to 0.010 weight percent tin, up to 0.015 weight percent arsenic, up to 0.015 weight percent aluminum, up to 0.0035 weight percent antimony, and up to 0.15 weight percent copper.

Methods are also generally provided for forming a cast alloy. In one embodiment, the method includes forming an alloy precursor; melting the alloy precursor to form a molten alloy composition; disposing the molten alloy composition into a casting mold; and cooling the molten alloy composition within the casting mold to form the cast alloy. The alloy precursor can include, by weight, 0.12% to 0.20% carbon, 0.50% to 0.90% manganese, 0.25% to 0.60% silicon, 0.10% to 0.50% nickel, 1.15% to 1.50% chromium, 0.90% to 1.50% molybdenum, 0.70% to 0.80% vanadium, 0.0075% to 0.060% titanium, 0.008% to 0.012% boron, the balance iron, and incidental impurities such as, but not limited to, up to 0.012 weight percent phosphorous, up to 0.012 weight percent sulfur, up to 0.010 weight percent tin, up to 0.015 weight percent arsenic, up to 0.015 weight percent aluminum, up to 0.0035 weight percent antimony, and up to 0.15 weight percent copper.

In one particular embodiment, the method further includes heat treating the cast alloy at a treatment temperature of about 1700° F. to about 1975° F. for about 4 hours to about 48 hours; and tempering the cast alloy by heating to a tempering temperature of about 1200° F. to about 1300° F. for about 4 hours to about 48 hours.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
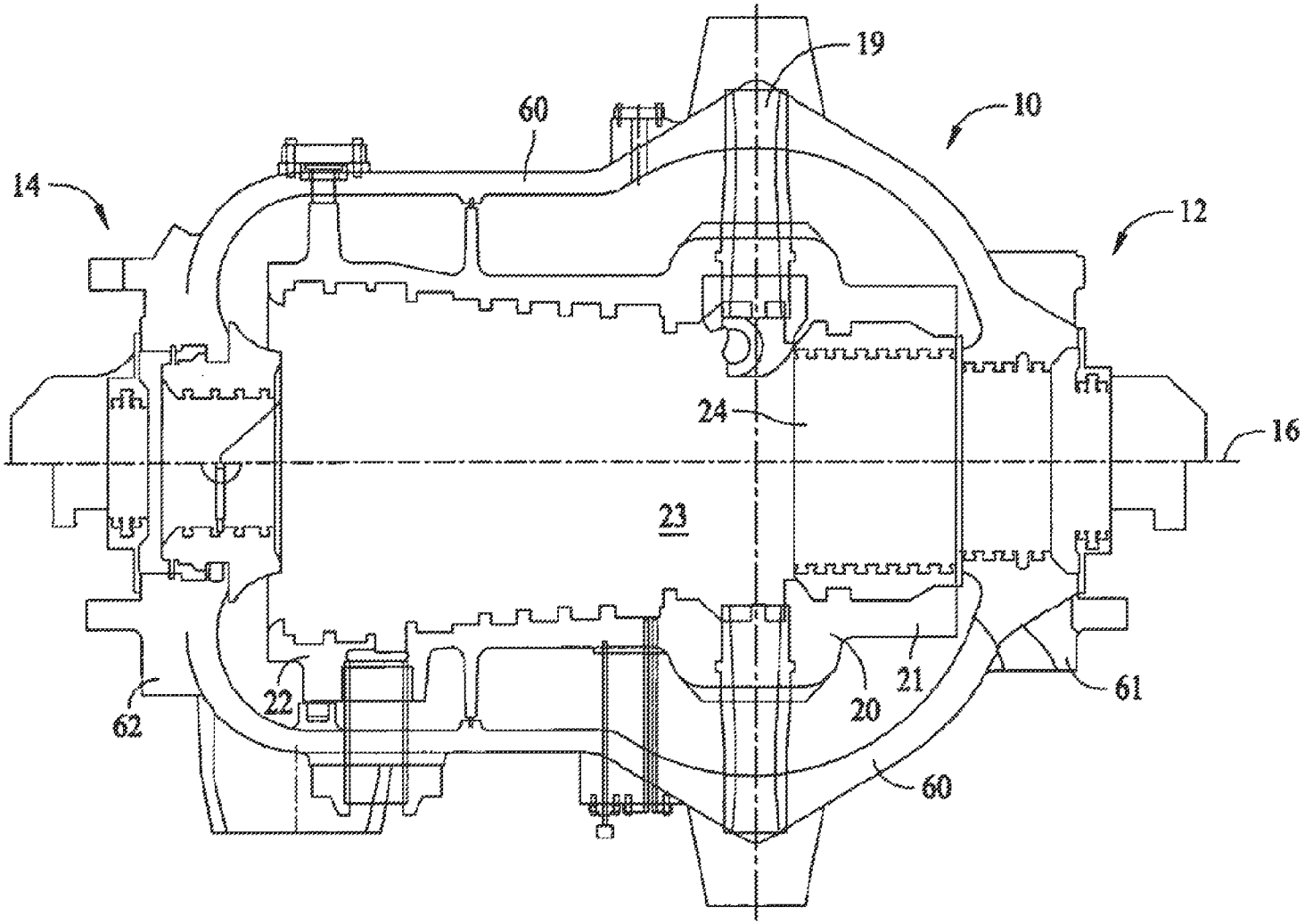
FIG. 1 is a schematic side view of an exemplary steam turbine, according to one embodiment of this invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

A cast CrMoV low-alloy steel is generally provided, along with methods of casting articles therefrom. In one embodiment, the cast CrMoV low-alloy steel provides a bridge in space between 9-12% Cr and traditional CrMoV steels in terms of performance, and has the potential to reduce cost (as replacement to 9-12% Cr steels in application up to 1080° F.). Additionally, the cast CrMoV low-alloy steel has improved properties over the currently available CrMoV steels, including better creep properties compared to currently used materials. As such, the wall thickness of certain stationary components in a turbine (e.g., a casing shell) can be reduced without sacrificing reliability. The cast CrMoV low alloy steel can be, in one particular embodiment, used as a replacement to 9-12% Cr steel castings in 1050° F. to 1080° F. applications. Furthermore, by avoiding the use of 9-12% Cr steel castings and other alloys having coefficients of thermal expansion different from conventional CrMoV alloy steels, castings produced from the presently provided alloy can be utilized in the service market as part of a retrofit package for performance enhancement of existing turbine units, as well as in new turbine designs.

The cast CrMoV low-alloy steel is particularly suitable for use in forming a stationary component of turbines (e.g., steam turbines, gas turbines, gas turbine engines, and jet engines). To achieve the mechanical properties necessary for use as a stationary component of a turbine, the alloy is configured for use at operating temperatures of 1050° F. to 1080° F.

In one embodiment, the cast alloy includes, by weight, 0.12% to 0.20% carbon (e.g., 0.14% to 0.17% carbon), 0.50% to 0.90% manganese, 0.25% to 0.60% silicon (e.g., 0.25% to 0.35% silicon), 0.10% to 0.50% nickel (e.g., 0.20% to 0.35% nickel), 1.15% to 1.50% chromium, 0.90% to 1.50% molybdenum, 0.70% to 0.80% vanadium (e.g., 0.74% to 0.77% vanadium), 0.0075% to 0.060% titanium (e.g., 0.010% to 0.035% titanium), 0.008% to 0.012% boron (e.g., 0.009% to 0.010% boron), the balance iron, optionally low levels of other alloying constituents, and incidental impurities. For example, in one particular embodiment, the cast alloy consists of, by weight, 0.12% to 0.20% carbon, 0.50% to 0.90% manganese, 0.25% to 0.60% silicon, 0.10% to 0.50% nickel, 1.15% to 1.50% chromium, 0.90% to 1.50% molybdenum, 0.70% to 0.80% vanadium, 0.0075% to 0.060% titanium, 0.008% to 0.012% boron, the balance iron, and incidental impurities.

Due to the casting methods utilized in forming the cast CrMoV low-alloy steel, silicon has been included while the relative amount of carbon present has been reduced, when compared to the CrMoV low alloy steel described in U.S. Publication No. 2011/0070088 directed to a CrMoV low alloy steel tailored to be forged into rotary components of a turbine. Without wishing to be bound by any particular theory, it is believed that the relatively high amount of silicon and the relatively low amount of carbon in the cast alloy (particularly when compared to the CrMoV low alloy steel described in U.S. Publication No. 2011/0070088) allows for sufficient fluidity upon melting to allow the molten alloy composition to flow into the casting mold.

As stated, incidental impurities may be present in the cast alloy. For example, in certain embodiments, incidental impurities that may be present in the cast alloy can be, by weight, up to 0.012% phosphorous (e.g., 0.001% to 0.005% phosphorous), up to 0.002% sulfur (e.g., 0.0005% to 0.002% sulfur), up to 0.010% tin (e.g., 0.001% to 0.004% tin), up to 0.015% arsenic (e.g., 0.001% to 0.004% arsenic), up to 0.015% aluminum (e.g., 0.001% to 0.005% aluminum), up to 0.0035% antimony (e.g., 0.001% to 0.0025% antimony), and/or up to 0.15% copper (e.g., 0.005% to 0.015% copper). As such, in one particular embodiment, the cast alloy consists of carbon (e.g., 0.12% to 0.20% carbon), manganese (e.g., 0.50% to 0.90% manganese), silicon (e.g., 0.25% to 0.60% silicon), nickel (e.g., 0.10% to 0.50% nickel), chromium (e.g., 1.15% to 1.50% chromium), molybdenum (e.g., 0.90% to 1.50% molybdenum), vanadium (e.g., 0.70% to 0.80% vanadium), titanium (e.g., 0.0075% to 0.060% titanium), boron (e.g., 0.008% to 0.012% boron), iron, up to 0.012% phosphorous (e.g., 0.001% to 0.005% phosphorous), up to 0.002% sulfur (e.g., 0.0005% to 0.002% sulfur), up to 0.010% tin (e.g., 0.001% to 0.004% tin), up to 0.015% arsenic (e.g., 0.001% to 0.004% arsenic), up to 0.015% aluminum (e.g., 0.001% to 0.005% aluminum), up to 0.0035% antimony (e.g., 0.001% to 0.0025% antimony), up to 0.15% copper (e.g., 0.005% to 0.015% copper), and other incidental impurities (if present).

As stated, the cast CrMoV low-alloy steel is particularly suitable for use in forming a stationary component of turbines. For example, referring to FIG. 1, a schematic illustration of an exemplary steam turbine 10 is generally shown. Steam turbine 10 defines a first or generator end portion 12 and an opposing second or turbine end portion 14. Steam turbine 10 includes a rotor shaft (not shown in FIG. 1) that extends along at least a portion of an axial centerline 16 of steam turbine 10. During operation of steam turbine 10, high pressure steam from a steam source, such as a power boiler (not shown), enters steam turbine 10 at steam inlet 19 and exits at turbine end portion 14, as shown in FIG. 1.

Figure 2:
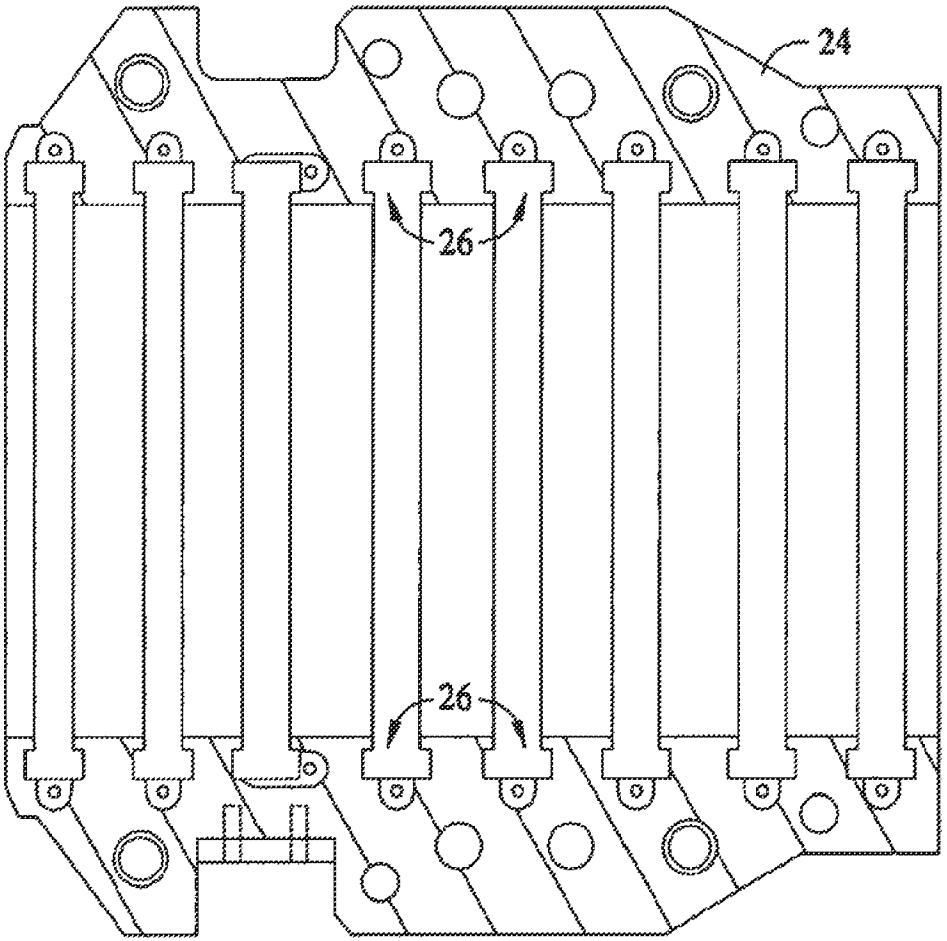
FIG. 2 is an enlarged sectional view of a packing head for the steam turbine shown in FIG. 1.
Figure 3:
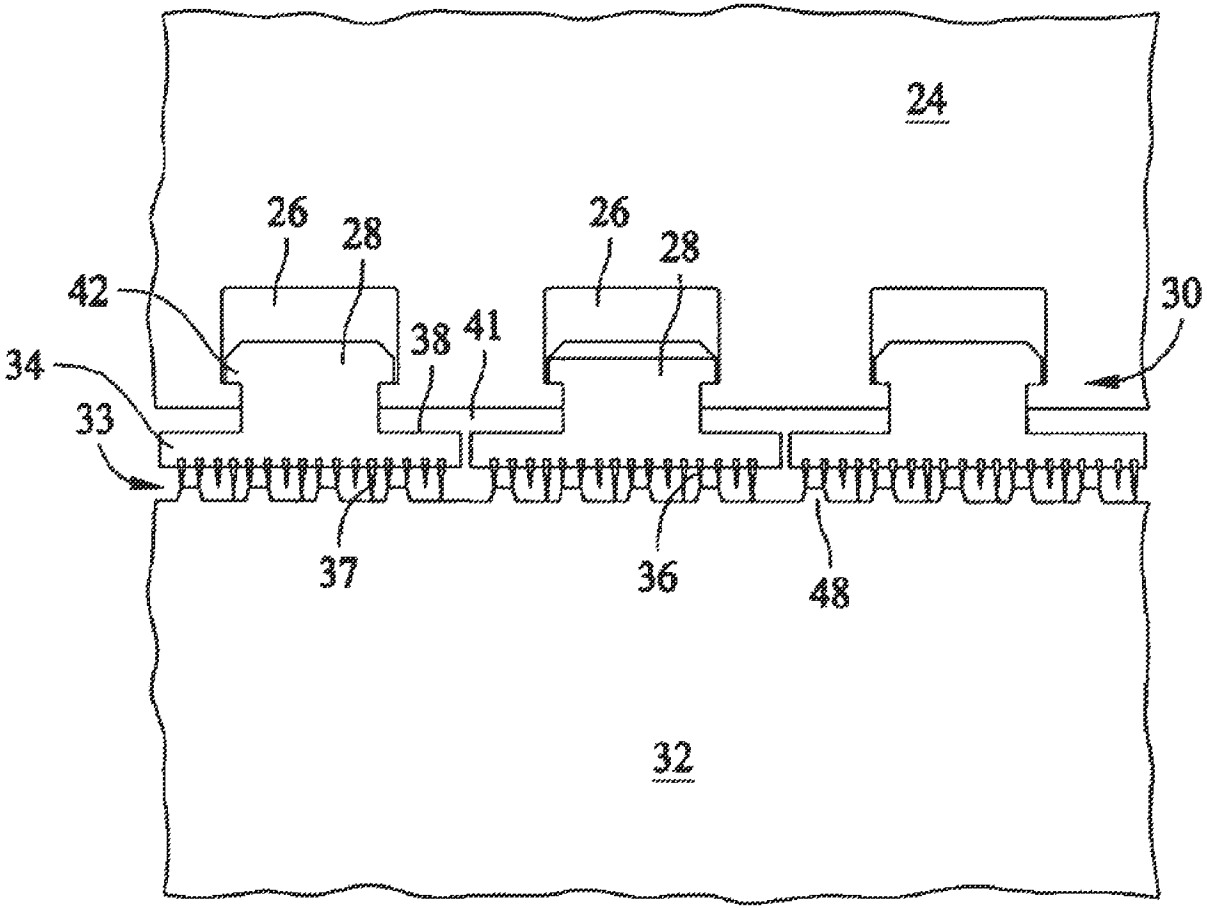
FIG. 3 shows a section of a seal assembly for the steam turbine shown in FIG. 1, according to one embodiment of this invention.

A stationary inner shell 20 is positioned about the rotor shaft and extends along axial centerline 16. Inner shell 20 includes a generator end surface 21 and an opposing turbine end surface 22. Inner shell forms a chamber 23 within which the rotor shaft is positioned. As shown in FIG. 1, a packing head 24 is connected to inner shell 20 and positioned within chamber 23. Packing head 24 is circumferentially positioned about the rotor shaft and axial centerline 16. Referring further to FIG. 2, packing head 24 includes a plurality of channels 26. In one embodiment, packing head 24 includes eight channels 26 formed along an axial length of packing head 24. Referring further to FIG. 2, each channel 26 extends circumferentially about axial centerline 16 and is dimensioned to receive a packing ring 28. As shown in FIG. 3, each packing ring 28 is retained in a corresponding channel 26 defined in packing head 24. In alternative embodiments, packing head 24 includes any suitable number of channels 26.

In one embodiment, steam turbine 10 includes a seal assembly 30, as shown in FIG. 3. In FIG. 3, only a portion of a rotor shaft 32 and a portion of packing head 24 are illustrated. A radial clearance 33 is defined between rotor shaft 32 and packing head 24 and/or packing rings 28. Each packing ring 28 includes an inner ring portion 34 having teeth 36 extending from a radially inner surface 37 of inner ring portion 34, and a radially outer surface 38 that facilitates controlling radial clearance or gap 33 by contacting a radial surface 41 of packing head 24. Each packing ring 28 also includes an outer ring portion 42 that is positioned within channel 26.

Packing ring 28 includes a plurality of teeth 36 positioned in opposition to a plurality of rotor shaft circumferential projections 48 extending outward from rotor shaft 32. A positive force may force fluid flow between the multiple restrictions formed within radial clearance 33 defined at least partially between teeth 36 and rotor shaft 32. More specifically, radial clearance 33, the number and relative sharpness of teeth 36, the number of rotor shaft circumferential projections 48 and/or the operating conditions, including pressure and density, are factors that determine the amount of leakage flow. Alternately, other geometrical arrangements can also be used to provide multiple or single leakage restrictions.

As shown in FIG. 1, steam turbine 10 includes an outer shell 60 that is positioned about inner shell 20. Outer shell 60 includes a first or generator end surface 61 and an opposing second or turbine end surface 62 generally corresponding with generator end surface 21 and turbine end surface 22 of inner shell 20, respectively. In one embodiment, inner shell 20 is aligned with outer shell 60 along transverse centerline 18 of steam turbine 10. Although shown as having an inner shell 20 and an outer shell 60, the turbine casing can be a single shell configuration in an alternative embodiment.

As stated, stationary components of the turbine 10 (e.g., inner shell 20, outer shell 20, packing head 24, packing rings 28, etc.) can be constructed from the cast CrMoV low-alloy steel described above. Although discussed with reference to steam turbine 10, it is understood that the cast CrMoV low-alloy steel can be utilized in stationary components of other types of turbines, including, but not limited to, gas turbines, gas turbine engines, and jet engines.

Figure 4:
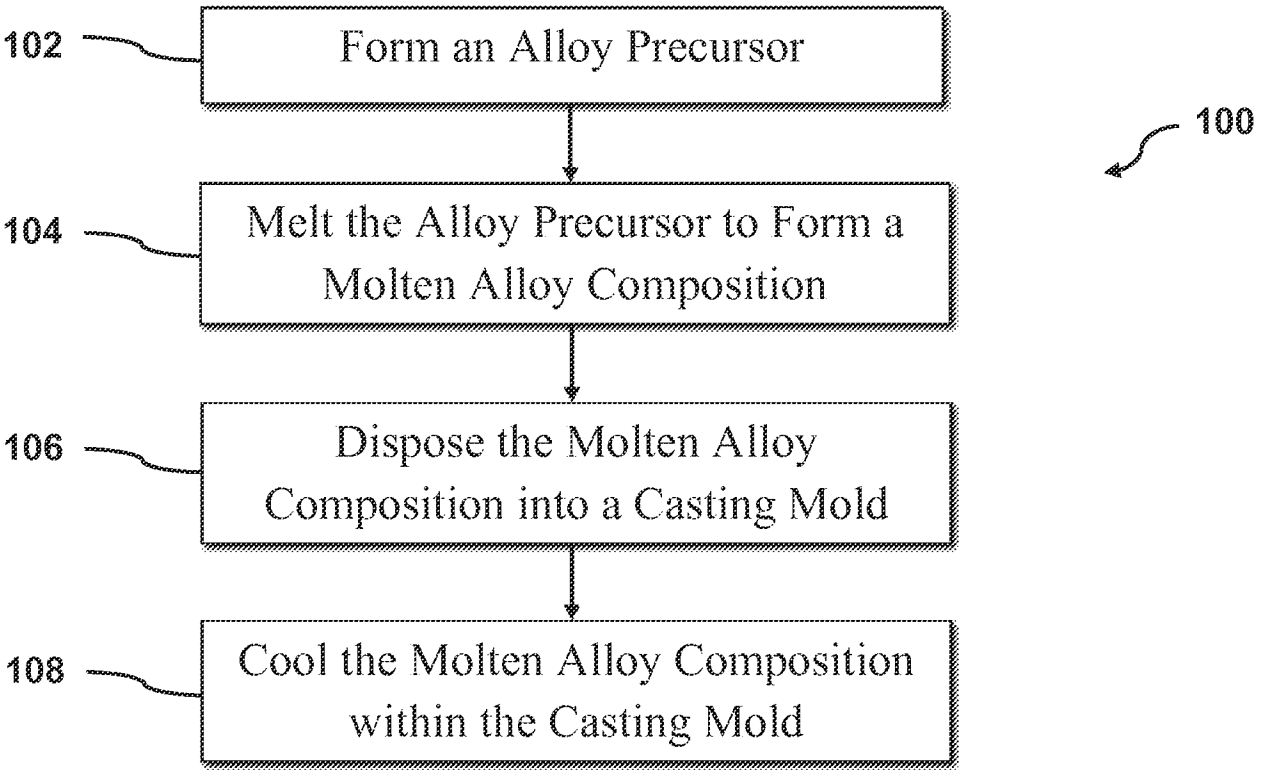
FIG. 4 shows a flow chart of an exemplary method suitable for forming a cast alloy according to one embodiment of the present invention.

Any suitable casting method can be utilized to form the stationary component from the CrMoV low-alloy steel, including but not limited to sand casting, centrifugal casting, etc. For example, FIG. 4 shows an exemplary method 100 of forming a cast alloy. Method 100 includes forming an alloy precursor at 102; melting the alloy precursor to form a molten alloy composition at 104; disposing the molten alloy composition into a casting mold at 106; and finally cooling the molten alloy composition within the casting mold to form the cast alloy at 108.

Generally, the alloy precursor formed in 102 and melted in 104 is formed from the components of final cast alloy in the desired weight percentage. For instance, in one embodiment, the alloy precursor comprises, by weight, 0.12% to 0.20% carbon (e.g., 0.14% to 0.17% carbon), 0.50% to 0.90% manganese, 0.25% to 0.60% silicon (e.g., 0.25% to 0.35% silicon), 0.10% to 0.50% nickel (e.g., 0.20% to 0.35% nickel), 1.15% to 1.50% chromium, 0.90% to 1.50% molybdenum, 0.70% to 0.80% vanadium (e.g., 0.74% to 0.77% vanadium), 0.0075% to 0.060% titanium (e.g., 0.010% to 0.035% titanium), 0.008% to 0.012% boron (e.g., 0.009% to 0.010% boron), the balance iron, optionally low levels of other alloying constituents, and incidental impurities. For example, in one particular embodiment, the alloy precursor consists of, by weight, 0.12% to 0.20% carbon, 0.50% to 0.90% manganese, 0.25% to 0.60% silicon, 0.10% to 0.50% nickel, 1.15% to 1.50% chromium, 0.90% to 1.50% molybdenum, 0.70% to 0.80% vanadium, 0.0075% to 0.060% titanium, 0.008% to 0.012% boron, the balance iron, and incidental impurities such as up to 0.012% phosphorous (e.g., 0.001% to 0.005% phosphorous), up to 0.002% sulfur (e.g., 0.0005% to 0.002% sulfur), up to 0.010% tin (e.g., 0.001% to 0.004% tin), up to 0.015% arsenic (e.g., 0.001% to 0.004% arsenic), up to 0.015% aluminum (e.g., 0.001% to 0.005% aluminum), up to 0.0035% antimony (e.g., 0.001% to 0.0025% antimony), and/or up to 0.15% copper (e.g., 0.005% to 0.015% copper). For example, in one particular embodiment, the alloy precursor consists of carbon (e.g., 0.12% to 0.20% carbon), manganese (e.g., 0.50% to 0.90% manganese), silicon (e.g., 0.25% to 0.60% silicon), nickel (e.g., 0.10% to 0.50% nickel), chromium (e.g., 1.15% to 1.50% chromium), molybdenum (e.g., 0.90% to 1.50% molybdenum), vanadium (e.g., 0.70% to 0.80% vanadium), titanium (e.g., 0.0075% to 0.060% titanium), boron (e.g., 0.008% to 0.012% boron), iron, up to 0.012% phosphorous (e.g., 0.001% to 0.005% phosphorous), up to 0.002% sulfur (e.g., 0.0005% to 0.002% sulfur), up to 0.010% tin (e.g., 0.001% to 0.004% tin), up to 0.015% arsenic (e.g., 0.001% to 0.004% arsenic), up to 0.015% aluminum (e.g., 0.001% to 0.005% aluminum), up to 0.0035% antimony (e.g., 0.001% to 0.0025% antimony), up to 0.15% copper (e.g., 0.005% to 0.015% copper), and other incidental impurities (if present).

After formation, the cast alloy can be heat treated at a treatment temperature of about 1700° F. to about 1975° F. within the casting mold for about 4 hours to about 48 hours (e.g., about 4 hours to about 24 hours). This heat treatment affects the microstructure of the resulting cast alloy, which in turn affects certain properties of the cast alloy (e.g., creep and fatigue properties). In one embodiment, the temperature and time of the heat treatment can be adjusted to control certain properties of the resulting treated cast alloy. For example, the heat treatment temperature can be about 1900° F. to about 1950° F. to increase the creep properties of the resulting treated cast alloy, which may be particularly desirable in cast alloy components of a steam turbine. Alternatively, the heat treatment temperature can be about 1750° F. to about 1800° F. to increase the fatigue properties of the resulting treated cast alloy, which may be particularly desirable in cast alloy components of a gas turbine.

Following heat treatment, the cast alloy can then be tempered by heating to a temperature of about 1200° F. to about 1300° F. for about 4 hours to about 48 hours (e.g., about 8 hours to about 24 hours). In one embodiment, the temperature and time of the tempering treatment can be adjusted to control certain properties of the resulting treated cast alloy (e.g., strength).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cast alloy comprising, by weight, 0.12% to 0.20% carbon, 0.50% to 0.90% manganese, 0.25% to 0.60% silicon, 0.10% to 0.50% nickel, 1.15% to less than 1.50% chromium, 0.90% to 1.50% molybdenum, 0.70% to 0.80% vanadium, 0.0075% to 0.060% titanium, 0.008% to 0.012% boron, the balance iron, and incidental impurities.

2. The cast alloy of claim 1, wherein the cast alloy consists of, by weight, 0.12% to 0.20% carbon, 0.50% to 0.90% manganese, 0.25% to 0.60% silicon, 0.10% to 0.50% nickel, 1.15% to less than 1.50% chromium, 0.90% to 1.50% molybdenum, 0.70% to 0.80% vanadium, 0.0075% to 0.060% titanium, 0.008% to 0.012% boron, the balance iron, and incidental impurities.

3. The cast alloy of claim 1, wherein the incidental impurities comprise, by weight, up to 0.012% phosphorous, up to 0.002% sulfur, up to 0.010% tin, up to 0.015% arsenic, up to 0.015% aluminum, up to 0.0035% antimony, and up to 0.15% copper.

4. The cast alloy of claim 1, wherein the incidental impurities comprise, by weight, 0.001% to 0.005% phosphorous, 0.0005% to 0.002% sulfur, 0.001% to 0.004% tin, 0.001% to 0.004% arsenic, 0.001% to 0.005% aluminum, 0.001% to 0.0025% antimony, and 0.005% to 0.015% copper.

5. The cast alloy of claim 1, wherein the cast alloy consists of carbon, manganese, silicon, nickel, chromium, molybdenum, vanadium, titanium, boron, iron, up to 0.012 weight percent phosphorous, up to 0.012 weight percent sulfur, up to 0.010 weight percent tin, up to 0.015 weight percent arsenic, up to 0.015 weight percent aluminum, up to 0.0035 weight percent antimony, and up to 0.15 weight percent copper.

6. The cast alloy of claim 5, wherein the cast alloy consists of, by weight, carbon, manganese, silicon, nickel, chromium, molybdenum, vanadium, titanium, boron, iron, 0.001% to 0.005% phosphorous, 0.0005% to 0.002% sulfur, 0.001% to 0.004% tin, 0.001% to 0.004% arsenic, 0.001% to 0.005% aluminum, 0.001% to 0.0025% antimony, and 0.005% to 0.015% copper.

7. The cast alloy of claim 1, wherein the cast alloy comprises, by weight, 0.25% to 0.35% silicon.

8. The cast alloy of claim 1, wherein the cast alloy comprises, by weight, 0.14% to 0.17% carbon.

9. The cast alloy of claim 1, wherein the cast alloy comprises, by weight, 0.010% to 0.035% titanium.

10. The cast alloy of claim 1, wherein the cast alloy comprises, by weight, 0.20% to 0.35% nickel.

11. The cast alloy of claim 1, wherein the cast alloy comprises, by weight, 0.009% to 0.010% boron.

12. The cast alloy of claim 1, wherein the cast alloy comprises, by weight, 0.74% to 0.77% vanadium.

13. A turbine having at least one stationary component cast from the cast alloy of claim 1.

14. The turbine of claim 13, wherein the stationary component is a shell, a packing head, or a packing ring.

15. A method of forming a cast alloy, comprising:

forming an alloy precursor comprising, by weight, 0.12% to 0.20% carbon, 0.50% to 0.90% manganese, 0.25% to 0.60% silicon, 0.10% to 0.50% nickel, 1.15% to less than 1.50% chromium, 0.90% to 1.50% molybdenum, 0.70% to 0.80% vanadium, 0.0075% to 0.060% titanium, 0.008% to 0.012% boron, the balance iron, and incidental impurities;

melting the alloy precursor to form a molten alloy composition;

disposing the molten alloy composition into a casting mold; and cooling the molten alloy composition within the casting mold to form the cast alloy.

16. The method of claim 15, wherein the incidental impurities comprise, by weight, up to 0.012% phosphorous, up to 0.012% silicon, up to 0.010% tin, up to 0.015% arsenic, up to 0.015% aluminum, up to 0.0035% antimony, and up to 0.15% copper.

17. The method of claim 15, wherein the alloy precursor consists of carbon, manganese, silicon, nickel, chromium, molybdenum, vanadium, titanium, boron, iron, up to 0.012 weight percent phosphorous, up to 0.012 weight percent silicon, up to 0.010 weight percent tin, up to 0.015 weight percent arsenic, up to 0.015 weight percent aluminum, up to 0.0035 weight percent antimony, and up to 0.15 weight percent copper.

18. The method of claim 15, further comprising:

heat treating the cast alloy at a treatment temperature of 1700° F. to 1975° F. for 4 hours to 48 hours; and tempering the cast alloy by heating to a tempering temperature of 1200° F. to 1300° F. for 4 hours to 48 hours.

19. The method of claim 18, wherein the treatment temperature is 1900° F. to 1950° F.

20. The method of claim 18, wherein the treatment temperature is 1750° F. to 1800' F.

* * * * *